US007821470B2

(12) United States Patent
Azhari

(10) Patent No.: US 7,821,470 B2
(45) Date of Patent: Oct. 26, 2010

(54) ANTENNA ARRANGEMENT

(75) Inventor: Alexander Azhari, Stockholm (SE)

(73) Assignee: Sony Ericsson Mobile Communications AB, Lund (SE)

( * ) Notice: Subject to any disclaimer, the term of this patent is extended or adjusted under 35 U.S.C. 154(b) by 103 days.

(21) Appl. No.: 12/175,784

(22) Filed: Jul. 18, 2008

(65) Prior Publication Data

US 2010/0013714 A1 Jan. 21, 2010

(51) Int. Cl.
*H01Q 1/38* (2006.01)

(52) U.S. Cl. ..... 343/846; 343/700 MS; 343/833

(58) Field of Classification Search ..... 343/702, 343/834, 846, 700 MS, 833
See application file for complete search history.

(56) References Cited

U.S. PATENT DOCUMENTS

| | | | | |
|---|---|---|---|---|
| 6,326,921 | B1 | 12/2001 | Egorov et al. | |
| 7,629,928 | B2 * | 12/2009 | Fabrega-Sanchez et al. | 343/700 MS |
| 2004/0227672 | A1 | 11/2004 | Chen et al. | |
| 2008/0055160 | A1 | 3/2008 | Kim et al. | |

FOREIGN PATENT DOCUMENTS

| | | | |
|---|---|---|---|
| EP | 0 942 488 | A2 | 9/1999 |
| EP | 1 052 723 | A2 | 11/2000 |
| EP | 1 755 191 | A1 | 2/2007 |
| WO | WO 2006/031170 | | 3/2006 |
| WO | WO 2006/120817 | | 11/2006 |

OTHER PUBLICATIONS

Written Opinion of the International Searching Authority corresponding to PCT/EP2009/050529 dated May 11, 2009, 11 pages.
Patent Cooperation Treaty International Search Report and Written Opinion of the International Searching Authority corresponding to PCT/EP2009/050528 dated May 11, 2009, 10 pages.
Co-pending U.S. Appl. No. 12/175,828, filed Jul. 18, 2008, entitled "Antenna Arrangement," [Alexander Azhari].

* cited by examiner

*Primary Examiner*—Michael C Wimer
(74) *Attorney, Agent, or Firm*—Harrity & Harrity, LLP

(57) ABSTRACT

An antenna for a wireless communication may include a ground plane provided on a carrying structure, a feed element, and a radiating element coupled to the feed element, the radiating element being substantially parallel to and vertically displaced from the ground plane by the feed element and a shortening element. The antenna may also include a parasitic element provided directly on the carrying structure as part of the carrying structure ground layer.

6 Claims, 3 Drawing Sheets

ANTENNA ARRANGEMENT

TECHNICAL FIELD

The present invention generally relates to antennas and, more particularly, to a semi-planar inverted F-antenna (PIFA) including a parasitic element.

BACKGROUND OF THE INVENTION

Wireless communication equipment, such as cellular and other wireless telephones, wireless network (WiLAN) components, GPS receivers, mobile radios, pagers, etc., use multiband antennas to transmit and receive wireless signals in multiple wireless communication frequency bands. Consequently, one of the critical components of wireless devices is the antenna which should meet the demands of high performance in terms of high signal transmission strength, good reception of weak signals, increased (or narrowed, if required) bandwidth, and small dimensions.

In mobile telecommunication, electromagnetic waves in the microwave region are used to transfer information. An essential part of telecommunication devices is thus the antenna, which enables the reception and the transmission of electromagnetic waves.

Cellular systems may operate in two different frequency bands called GSM (global system for mobile) and DCS (digital communication system). In Europe, the frequency bands for GSM 900, which are located at 880 MHz to 960 MHz, and GSM 1800 (DCS), located at 1710 MHz to 1880 MHz, are used. Additionally, there is the GSM 850 frequency band from 824 MHz to 894 MHz and the GSM 1900 (PCS) frequency band from 1850 MHz to 1990 MHz widely used in the United States.

Planar inverted F-antennas (PIFAs) have many advantages. They are easily fabricated, have a simple design, and cost little to manufacture. Currently, the PIFA is widely used in small communication devices, such as cellular phones. This is due to the PIFA's compact size that makes it easy to integrate into a device's housing, thereby providing a protected antenna. The PIFA also provides an additional advantage over, for example, the popular whip antennas with respect to radiation exposure. A whip antenna has an omnidirectional radiation field, whereas the PIFA has a relatively limited radiation field towards the user.

The PIFA is generally a $\lambda/4$ resonant structure and is implemented by short-circuiting the radiating element to the ground plane using a conductive wall, plate or post. Thus, the conventional PIFA structure consists of a conductive radiator or radiating element disposed parallel to a ground plane and is insulated from the ground plane by a dielectric material, typically air. This radiating element connects to two pins, typically disposed toward one end of the element, giving the appearance of an inverted letter "F" from the side view. The first pin electrically connects the radiating element to the ground plane, and the second pin provides the antenna feed. The frequency bandwidth, gain, and resonant frequency of the PIFA depend on the height, width, and depth of the conductive radiator element, and the distance between the first pin connected to the radiating element and ground, and the second pin connected to the antenna feed.

FIG. 2 illustrates a conventional PIFA 200 design. The conventional PIFA 200 includes a conductive plate which forms a radiating element 209 of the antenna. Radiating element 209 is disposed about parallel to a ground plane 210 formed on a substrate 211. This parallel orientation between radiating element 209 and ground plane 210 provides optimal performance, but other orientations are possible.

Radiating element 209 electrically connects to ground plane 210 via a tuning or shortening element 212, most often disposed at one side of radiating element 209 and a feed element 213. Feed element 213 is somewhat electrically insulated from ground plane 210. When electric current is fed to radiating element 209 mounted above ground plane 210 through feed element 213, radiating element 209 and ground plane 210 become excited and act as a radiating device.

The operating frequency or the resonance frequency of PIFA 200 can be modified either by adjusting the dimensions and shape of radiating element 209 or by moving the location of feed element 213 with respect to tuning element 212. The resonance frequency can also be finely adjusted by changing the height and/or width of tuning element 212. Thus, in the conventional PIFA, the operating frequency or resonance is fixed by the size, shape, or placement of feed element 213, tuning element 212, or radiating elements 209, respectively. To change the bandwidth of PIFA 200, the height must be increased which will lead to an undesirable increase in the overall antenna size. With a trend towards smaller terminals, i.e., thinner and shorter mobile terminals, with very limited space available for the antenna element (GSM/WCDMA), the bandwidth of the High Band, DCS, PCS, and UMTS (1710 MHz->2170 MHz) at −6 dB S11 is becoming more difficult to achieve.

PIFAs with parasitic elements are being used currently to enhance the High Band bandwidth, but usually use a flex film on the antenna carrier with an additional connection (c-clip or Pogo Pin) on the PCB.

SUMMARY OF THE INVENTION

One object of the present invention is to employ a microstrip parasitic element (MPE) as a part of the ground layer of the carrying structure, e.g., printed circuit board (PCB) in such a way that the matching and bandwidth of the antenna are improved and increased.

Embodiments of the invention use an antenna arrangement including: a ground plane, a feed element, and a radiating element coupled to the feed element, the radiating element being substantially parallel to and vertically displaced from the ground plane arranged on a first surface of a carrying structure by the feed element and a shortening element. The antenna further includes a parasitic element provided directly on the carrying structure as part of the carrying structure ground layer. The parasitic element me be a microstrip that is arranged at a ground clearance area. The parasitic element may extend over an edge of said carrying structure. The parasitic element may also extend to a second surface of said carrying structure. The carrying structure may be a PCB.

The invention also relates to a wireless communication device having an antenna that includes: a ground plane provided on a carrying structure, a feed element, and a radiating element coupled to the feed element, the radiating element being substantially parallel to and vertically displaced from the ground plane by the feed element and a shortening element. The antenna further includes a parasitic element provided directly on the carrying structure as part of the carrying structure ground layer.

BRIEF DESCRIPTION OF THE DRAWINGS

The accompanying drawings, which are incorporated in and constitute a part of this specification, illustrate a number of embodiments of the invention and, together with the description, explain the invention. In the drawings.

DETAILED DESCRIPTION OF PREFERRED EMBODIMENTS

The antenna designs described in the following description are "planar" antennae. A "planar" antenna has an extended shape that lies generally along a plane, i.e., the antenna may have three dimensions but one of the dimensions may be an order of a magnitude less than the other two dimensions.

Figure 1:
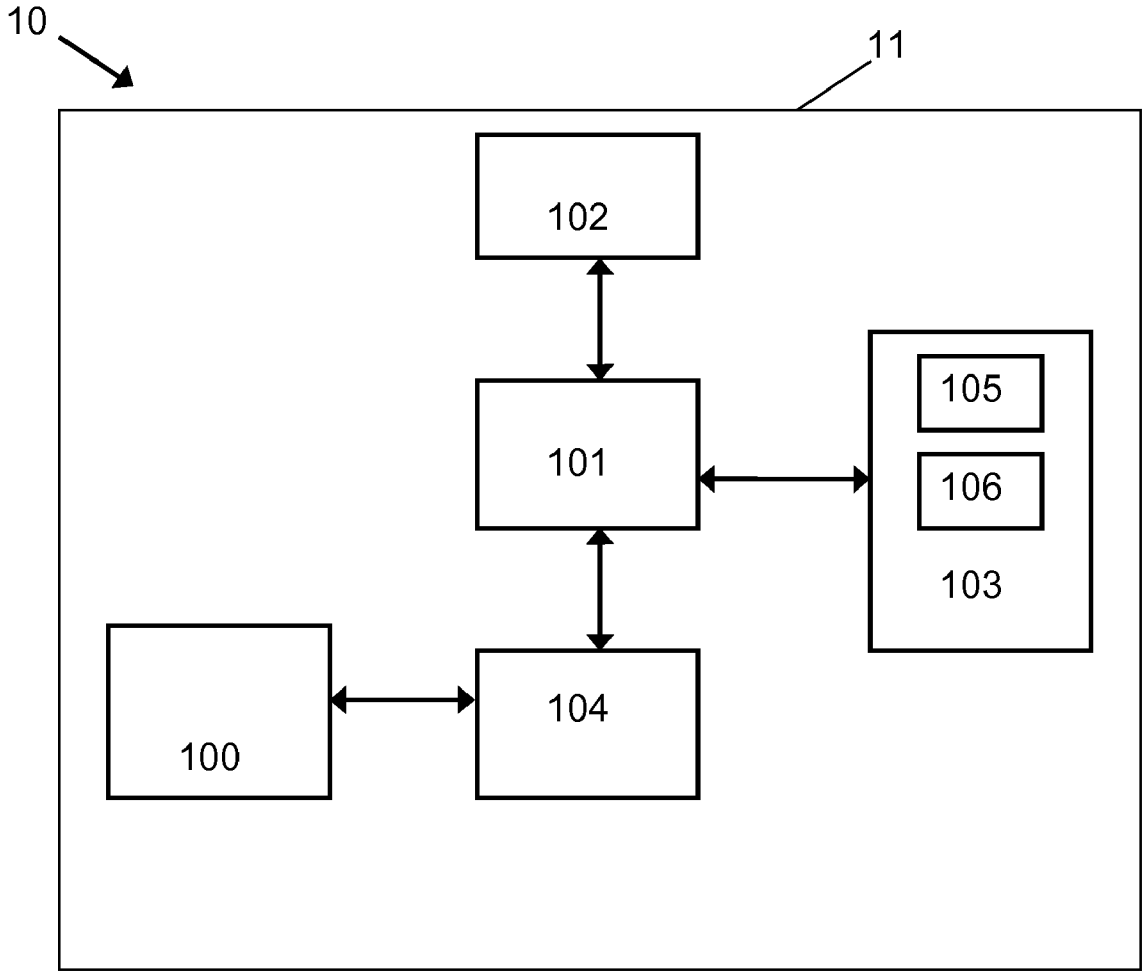
FIG. 1 illustrates a block diagram of a wireless communication device according to the present invention.
Figure 2:
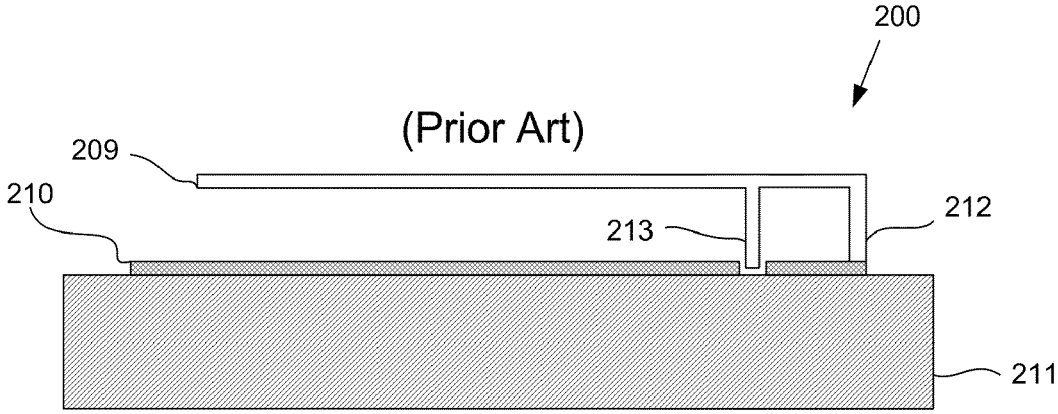
FIG. 2 illustrates a conventional PIFA design according to prior art.

FIG. 1 illustrates a block diagram of an exemplary wireless communication device 10. Wireless communication device 10 may include a housing 11, a controller 101, a memory 102, a user interface 103, a transceiver 104, a key input unit 105, a display unit 106, and a multiband antenna 100. Transceiver 104 may interface wireless communication device 10 with a wireless network using antenna 100. It is appreciated that transceiver 104 may transmit or receive signals according to one or more of any known wireless communication standards known to the person skilled in the art. Controller 101 may control the operation of wireless communication device 10 responsive to programs stored in memory 102 and instructions provided by the user via interface 103.

Antenna designs according to the present invention, with a microstrip parasitic element as part of the ground plane on the PCB, may improve and increase the matching and bandwidth.

Figure 3:
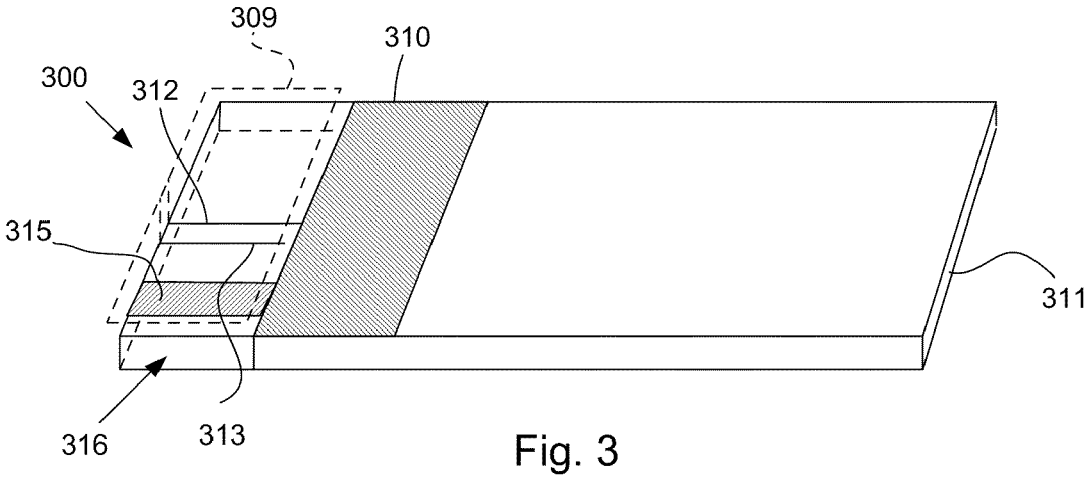
FIG. 3 illustrates a semi-PIFA according to the invention.

FIG. 3 illustrates an antenna, for example, a semi-PIFA according to the present invention. A PIFA 300 may include a ground plane 310 formed on a substrate 311. In this embodiment, ground plane 310 may be illustrated as being embedded directly on substrate 311 (e.g., a PCB), which also may carry other electrical components (not shown) of the device. This configuration may provide the advantage that the antenna can be mounted relatively close to the PCB, thus saving volume in the wireless device.

PIFA 300 may include a radiating element 309 that may include a low frequency radiating element and a high frequency radiating element respectively. Radiating element 309 may include any known configuration or pattern and vary in size to optimize the bandwidth, operating frequency, radiation patterns, and the like. Radiating element 309 may electrically connect to ground plane 310, for example, via a tuning or shortening element 312. Feed element 313 may connect to a signal source from a radio or other RF (radio frequency) transmitter, receiver, or transceiver (not shown) to radiating element 309. Feed 313 may be at least partially electrically insulated from ground plane 310, to prevent grounding therefrom.

To enhance the matching and bandwidth of the high-band, a parasitic element 315 may be arranged extending from ground plane 310, preferably on the antenna ground clearance area 316. Parasitic element 315 may have any regular or irregular shape, such as rectangular, circular, meander, etc.

Figure 5:
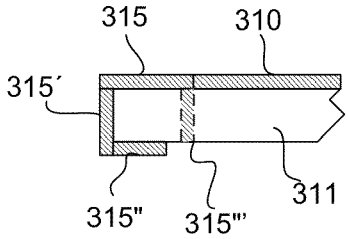
FIG. 5 illustrates a cross section through a part of a PCB.

If the size (e.g., length and width) of parasitic element 315 is not sufficient (e.g. <10 mm antenna ground clearance), it is also possible to continue with the microstrip to the other side of the PCB or any suitable direction. This is illustrated in FIG. 5, where 315' and 315" denote extension of the parasitic element over the edge of the PCB 311 and the other side of it, respectively. Parasitic element 315''' may also extend through a via.

The parasitic element according to the invention, which may be a narrowband, wide-beam antenna, may be fabricated by etching the antenna element pattern in metal trace bonded to an insulating dielectric substrate with a continuous metal layer bonded to the substrate which forms a ground plane. Possible microstrip antenna radiator shapes include square, rectangular, circular, and elliptical, but any continuous shape is possible. For example, the microstrip antenna may be a rectangular patch. The rectangular patch antenna may be approximately a one-half wavelength long section of rectangular microstrip transmission line. When air is the antenna substrate, the length of the rectangular microstrip antenna may be approximately one-half of a free-space wavelength. As the antenna is loaded with a dielectric as its substrate, the length of the antenna decreases as the relative dielectric constant of the substrate increases.

Figure 4:
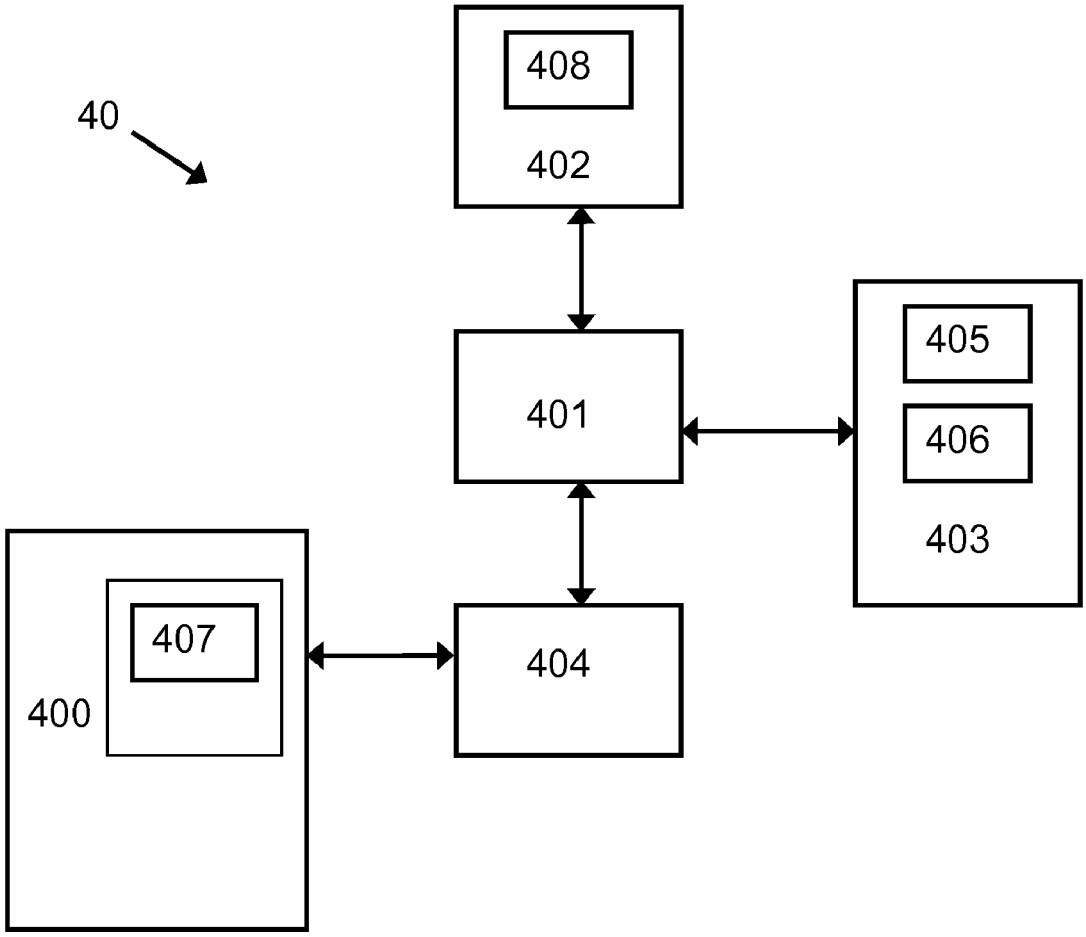
FIG. 4 illustrates a block diagram of a wireless communication device according to the invention.

FIG. 4 is a block diagram illustrating a structure of a mobile communication terminal 40 in accordance with an embodiment of the present invention. Referring to FIG. 4, mobile communication terminal 40 may include a memory 402, a key input unit 405, a display unit 406, a transceiver 404, a PIFA 400, including a parasitic element 407, and a controller 401. Controller 401 may process voice signals and/or data according to the protocol for a phone call, data communication, or wireless Internet access, and may control the respective components of the mobile communication terminal. Furthermore, controller 401 may receive key input from key input unit 405, and control display unit 406 to generate and provide image information in response to the key input. Controller 401 may receive current location information from the user or BS. Through the received location information, controller 401 may identify a frequency band mapped to the current location from a region frequency memory 408 included in memory 402.

It should be noted that the word "comprising" does not exclude the presence of other elements or steps than those listed and the words "a" or "an" preceding an element do not exclude the presence of a plurality of such elements. It should further be noted that any reference signs do not limit the scope of the claims, that the invention may be implemented at least in part by means of both hardware and software, and that several "means", "units" or "devices" may be represented by the same item of hardware.

The above mentioned and described embodiments are only given as examples and should not be limiting to the present invention. Other solutions, uses, objectives, and functions within the scope of the invention as claimed in the below described patent claims should be apparent for the person skilled in the art.

I claim:

1. An antenna comprising:

a ground plane;

a feed element;

a radiating element coupled to the feed element, the radiating element being substantially parallel to and vertically displaced from the ground plane arranged on a first surface of a carrying structure by the feed element and a shortening element; and a parasitic element provided directly on the carrying structure as part of a ground layer of the carrying structure, the parasitic element extending to a second surface of said carrying structure, where the second surface opposes the first surface.

2. The antenna of claim 1, wherein the parasitic element comprises a microstrip.

3. The antenna of claim 1, wherein the parasitic element is arranged at a ground clearance area.

4. The antenna of claim 1, wherein the parasitic element extends over a side edge of the carrying structure.

5. The antenna of claim 1, wherein the carrying structure is printed circuit board.

6. The antenna of claim 1, wherein the parasitic element extends, through a via in the carrying structure, from the first surface to the second surface.

* * * * *